US006129574A

United States Patent [19]

Okayasu et al.

[11] Patent Number: 6,129,574

[45] Date of Patent: Oct. 10, 2000

[54] CONNECTOR HAVING A CONSTRUCTION FOR PREVENTING AN ERRONEOUS ASSEMBLING OF A CONNECTOR HOUSING AND A COVER

[75] Inventors: Yasushi Okayasu; Toshikazu Sakurai, both of Yokkaichi, Japan

[73] Assignee: Sumitomo Wiring Systems, Ltd., Japan

[21] Appl. No.: 09/327,786

[22] Filed: Jun. 7, 1999

[30] Foreign Application Priority Data

Jun. 5, 1998 [JP] Japan ..... 10-157268

[51] Int. Cl.[7] ..... H01R 4/24

[52] U.S. Cl. ..... 439/404; 439/459

[58] Field of Search ..... 439/398–404, 439/417, 456, 459

[56] References Cited

U.S. PATENT DOCUMENTS

| | | | |
|---|---|---|---|
| 4,380,361 | 4/1983 | Asick et al. | 439/358 |
| 4,891,019 | 1/1990 | Olsson | 439/404 |
| 5,626,490 | 5/1997 | Pitts et al. | 439/404 |
| 5,833,486 | 11/1998 | Shinozaki | 439/404 |
| 5,954,541 | 9/1999 | Ozai et al. | 439/608 |

FOREIGN PATENT DOCUMENTS

| | | |
|---|---|---|
| 0 650 218 | of 1995 | European Pat. Off. . |
| 0 773 599 | of 1997 | European Pat. Off. . |
| 9-129276 | of 1997 | Japan . |
| 9-129297 | of 1997 | Japan . |

*Primary Examiner*—Khiem Nguyen
*Assistant Examiner*—Son V. Nguyen
*Attorney, Agent, or Firm*—Anthony J. Casella; Gerald E. Hespos; Michael J. Porco

[57] ABSTRACT

A construction is provided for preventing an erroneous assembly of a connector housing and a cover. The construction includes a pair of locking portions (8) that project at the top and bottom of each of left and right side portions of a two-contact connector (1). On the other hand, cover-side projections (35, 36) project from upper and lower walls of a five-contact cover (32). If the connector housing (1) is inserted into a mount opening (34) of the cover (32), the locking portions (8) shown at the shown right side come into contact with the cover-side projections (35, 36) of the cover (32). Thus, even if an attempt is made to forcibly insert the connector housing (1) into the cover (32), this cannot be done by the mutual interference of the locking portions (8) and the projections (35, 36). In this way, an error assembling of the connector housing (1) and the cover (32) can be prevented.

9 Claims, 12 Drawing Sheets

CONNECTOR HAVING A CONSTRUCTION FOR PREVENTING AN ERRONEOUS ASSEMBLING OF A CONNECTOR HOUSING AND A COVER

BACKGROUND OF THE INVENTION

1. Field of the Invention

The present invention relates to a construction for preventing an erroneous means assembly of a connector housing and a cover. The invention also relates to a connector comprising the construction for preventing the erroneous assembly. The construction and the connector are particularly useful for branching off a wire or electrical circuit from a wire of a wire harness at an intermediate portion thereof.

2. Detailed Description of the Related Art

The prior art includes a terminal fitting provided with a crimping portion to be connected with a core of a wire by cutting an insulation coating on the wire. The prior art also includes a connector housing capable of accommodating such a crimping terminal fitting. The prior art connector housing has a cover for covering the crimping portion of the terminal fitting. Further, the connector housing and the cover are provided with locking portions for holding the housing and cover in an engaged condition.

This connector is assembled by accommodating the terminal fitting in a cavity of the connector housing; and then covering the crimping portion with the cover. The locking portions then are engaged to hold the connector housing and the cover locked to each other.

The prior art cover and connector housing, as described above, can be assembled with each other depending on the number of the terminal fittings to be handled. On the other hand, for the sake of convenience in designing, the locking portions used for engaging the cover and the connector housing have the same shapes regardless of the number of the terminal fittings to be handled.

Accordingly, even if the connector housing has a smaller number of positions of electric contacts than the cover, the connector housing and the cover may be assembled because the locking portions thereof are engageable with each other. Upon an occurrence of such an event, there may be terminal fittings whose crimping portions are not covered by the cover or a locking force of the locking portions may not be sufficient.

In view of the above problem, an object of the present invention is to provide a construction for preventing an erroneous assembly of a connector and a cover and a connector comprising the same.

SUMMARY OF THE INVENTION

According to the invention, there is provided a construction for preventing an erroneous assembly of a connector housing and a cover having different numbers of positions of electric contacts. The connector housing is provided internally with a selected number of cavities for accommodating terminal fittings. The cover can be assembled with the connector housing depending on the number of positions of electric contacts of the connector housing. The cover substantially guides or positions wires to be connected with the terminal fittings accommodated in the connector housing, and preferably holds the wires connected and in a bent state. The construction comprises locking portions, on or at the substantially opposite side portions of the connector housing. The locking portions preferably bulge outwardly. Receiving portions are provided on or at the substantially opposite side surfaces of the cover for receiving the locking portions. One or more projections are provided on an inner surface of the cover in conformity with the interval of the cavities. The connector housing and the cover can be assembled without the locking portions and the projections interfering with each other if the connector housing and the cover have the same number of positions of electric contacts. On the other hand, the locking portions and the projections interfere with each other to prevent an improper assembling of the connector housing and the cover if the connector housing has a smaller number of positions of electric contacts than the cover due to mutual interference of the locking portions and projections.

According to a preferred embodiment of the invention, the projections substantially extend at least to the height of the receiving portions.

The projections may also serve as wire guides for drawing wires connected with the terminal fittings out of the connector and partitioning the wires. Accordingly, it is not necessary to provide two separate members to prevent the erroneous assembly and to partition the wires.

The receiving portions may comprise guide grooves which are open at a side of the cover to be connected with the connector housing. The guide grooves may extend substantially in a connection direction of the cover and the connector housing. Thus the guide grooves guide the cover in the connection direction by engaging the locking portions when the cover is assembled with the connector housing. Accordingly, when the cover and the connector housing are to be connected, the locking portions are fitted into the guide grooves to guide the cover in the connection direction. Thus, the connection can be performed smoothly.

According to the invention, there is further provided a construction for preventing an erroneous assembly of a connector housing and a cover that have different numbers of positions of electric contacts. The connector housing is provided internally with cavities for accommodating a corresponding number of terminal fittings. The cover can be assembled with the connector housing depending on the number of positions of electric contacts of the connector housing. Additionally, the cover substantially guides or positions wires so as to be connected with the terminal fittings accommodated in the connector housing, and preferably holds the connected wires in a bent state. The construction comprises at least one housing-side projection and at least one cover-side projection provided on the substantially opposing surfaces of the connector housing and the cover and projecting toward the cover and the connector housing, respectively.

The connector housing and the cover can be assembled without the housing-side and cover-side projections interfering with each other if they have the same number of positions of electric contacts. On the other hand, if the connector housing has a smaller number of positions of electric contacts than the cover, the connector housing and the cover cannot be connected because of the interference of the housing-side and cover-side projections, thereby preventing an erroneous assembly.

According to a preferred embodiment, a space defined by substantially opposing surfaces of the connector housing and the cover are partitioned by the housing-side and cover-side projections into a number of partitioned spaces corresponding to the number of positions of electric contacts of the connector. The respective partitioned spaces serve as guiding spaces for drawing the wires out of the connector. Accordingly, guiding spaces for drawing the wires out of the connector are defined by the housing-side and cover-side projections. Therefore, one member performs the two functions of preventing the error assembling of the connector housing and the cover and serving as the wire guide. Preferably, the cover holds wires connected with the terminal fittings accommodated in the connector housing in a bent state.

According to the invention, there is further provided a connector for branching off a wire or electrical circuit from a wire of a wire harness at an intermediate portion thereof. The connector comprises a connector housing that is provided internally with a corresponding number of cavities for accommodating terminal fittings. The connector also has a cover having different numbers of positions of electric contacts. The cover can be assembled with the connector housing depending on the number of positions of electric contacts of the connector housing and substantially positions or guides wires so as to be connected with terminal fittings accommodated in the connector housing. The connector also includes the above-described construction for preventing an error assembling of the connector housing and the cover.

According to a preferred embodiment of the invention, a mating connector can be connected to the connector housing at an end thereof substantially opposite from the end where the cover is to be connected.

These and other objects, features and advantages of the present invention will become more apparent upon a reading of the following detailed description and accompanying drawings.

DETAILED DESCRIPTION OF THE PREFERRED EMBODIMENTS

Figure 1:
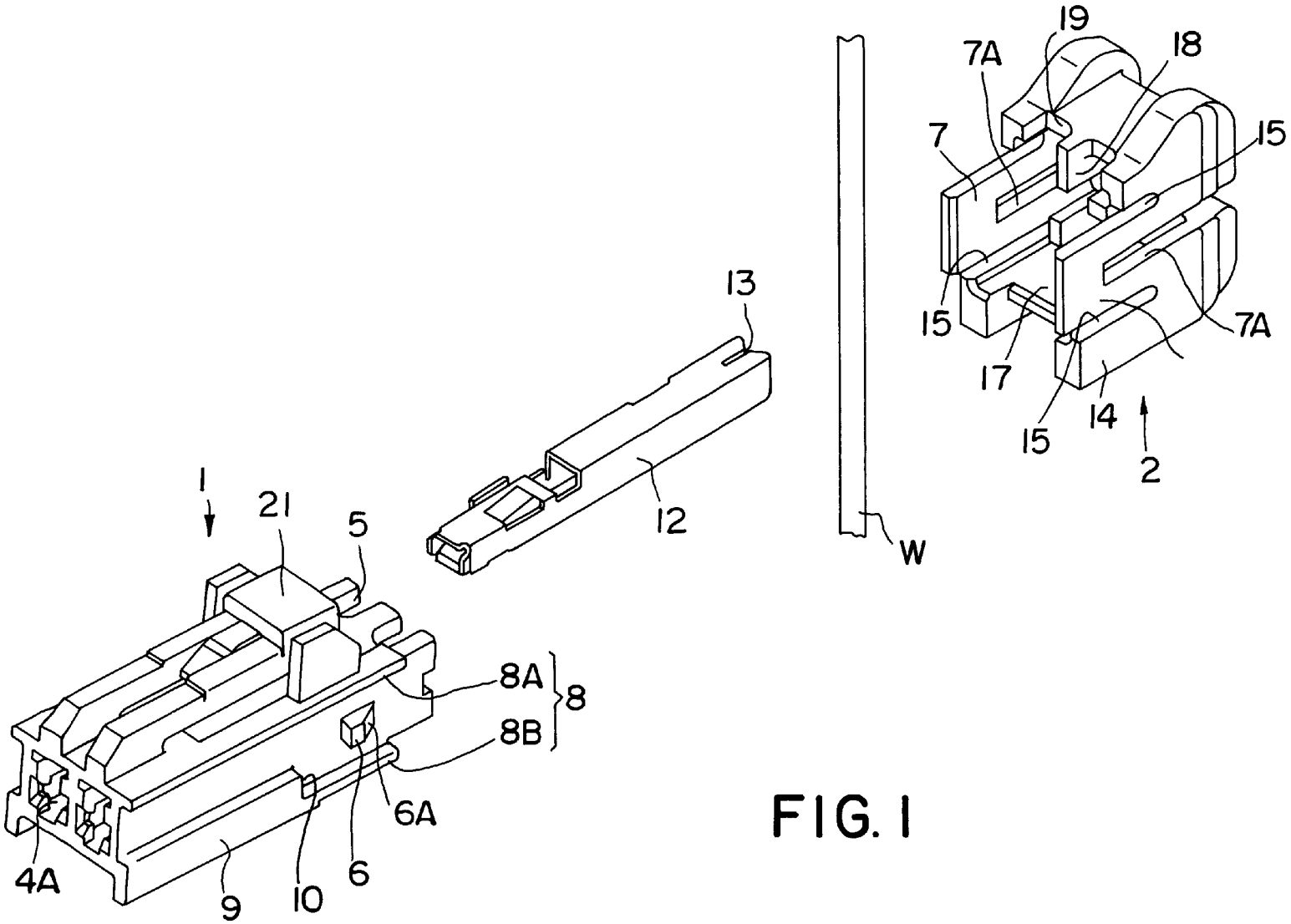
FIG. 1 is a perspective view showing a two-contact cover and a two-contact connector housing before they are assembled.

A two-contact cover-provided connector in accordance with the invention is identified by the numeral 11 in FIGS. 1 to 4. The connector 11 is provided with a two-contact connector housing 1 and a two-contact cover 2. Female terminal fittings 12 are mounted or mountable in the connector housing 1.

Each female terminal fitting 12 is formed e.g. by bending an electrically conductive plate and is provided at its front part with a connection portion 12A into which a tab of a mating terminal fitting (not shown) is insertable. A pair of crimping portions 13 are formed in the lateral, e.g. upper and lower surfaces of a rear end portion of the female terminal fitting 12. The crimping portions 13 are open backwardly, which is a direction away from a connection portion with the mating terminal fitting). When a wire W is pushed into the crimping portions 13, the crimping portions 13 cut an insulation coating of the wire W, thereby being electrically connected with a core of the wire W.

The connector housing 1 is integrally or unitarily made e.g. of a synthetic resin and two cavities 4 for accommodating two female terminal fittings 12 are provided therein. The cavities 4 are partitioned by a partition wall 3 provided therebetween. Each cavity 4 penetrates the connector housing 1 along forward and backward direction (a side to be connected with an unillustrated mating connector is assumed to be front). A front end portion of each cavity 4 serves as a terminal connection opening 4A through which the tab of the mating terminal fitting (not shown) is insertable, whereas a rear end portion thereof is widened to serve as a terminal insertion opening 4B through the female terminal fitting 12 is or can be inserted. Wire grooves 5 are formed at the upper and lower parts of the edge of the terminal insertion opening 4B. The wire grooves 5 preferably are in the form of U-shaped notches having a size substantially corresponding to the outer diameter of the wire W. A locking projection 6 projects from each of the left and right side surfaces of a rear portion of the connector housing 1. A guide surface 6A is formed at the rear surface of each locking projection 6. The locking projections 6 are engaged or engageable with elastic engaging pieces 7 of the cover 2 to be described later so as to substantially hold the connector housing 1 and the cover 2 locked to each other.

Figure 3:
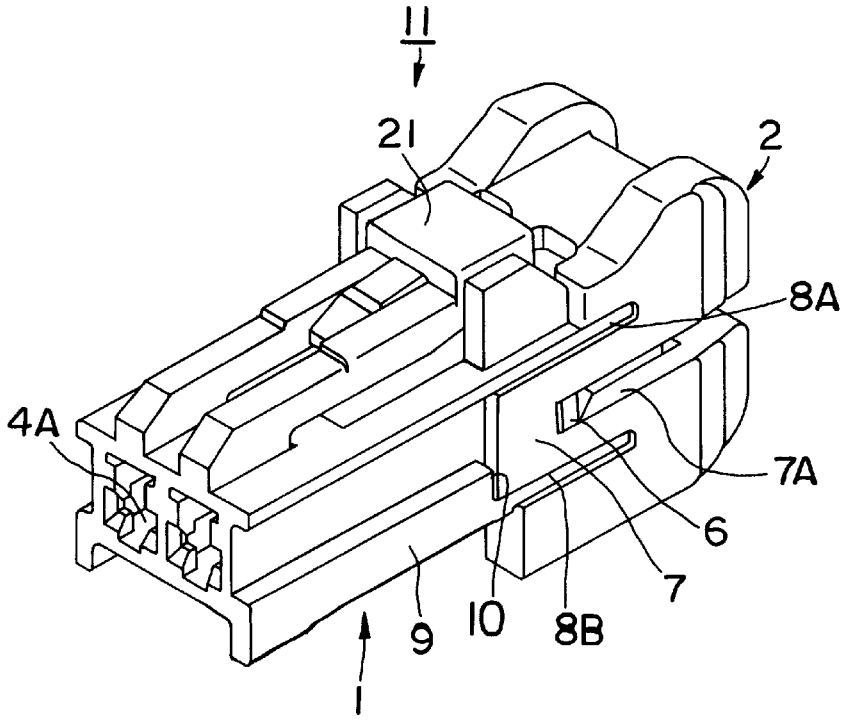
FIG. 3 is a perspective view of a two-contact cover-provided connector.

Locking (or guiding) portions 8 are formed on the left and right side portions of the connector housing 1, and preferably bulge or project outwardly. Upper locking portions 8A are provided substantially at the top of the connector housing 1, and preferably extend from the front end of the connector housing 1 to a position in alignment with the deepest position of the wire grooves 5. On the other hand, lower locking portions 8B preferably extend from a position slightly behind the longitudinal center of the connector housing 1 to a position in alignment with the rear end position of the upper locking portions 8A. Reinforcing portions 9 having a larger thickness than the lower locking portions 8B project from the connector housing 1 from the front end position of the lower locking portions 8B to the front end position of the connector housing 1. A step portion 10 is substantially formed at a boundary between the corresponding reinforcing portion 9 and lower locking portion 8B. When the connector housing 1 and the cover 2 are assembled properly, the leading ends of the elastic engaging pieces 7 of the cover 2 substantially abut against the step portions 10 (FIG. 3). A lock arm 21 is formed preferably in the middle of the upper surface of the connector housing 1 to lock this connector with an unillustrated mating connector. One end of the lock arm 21 is securely fixed to the front end surface of the connector housing 1, while the other end thereof hangs free.

Figure 2:
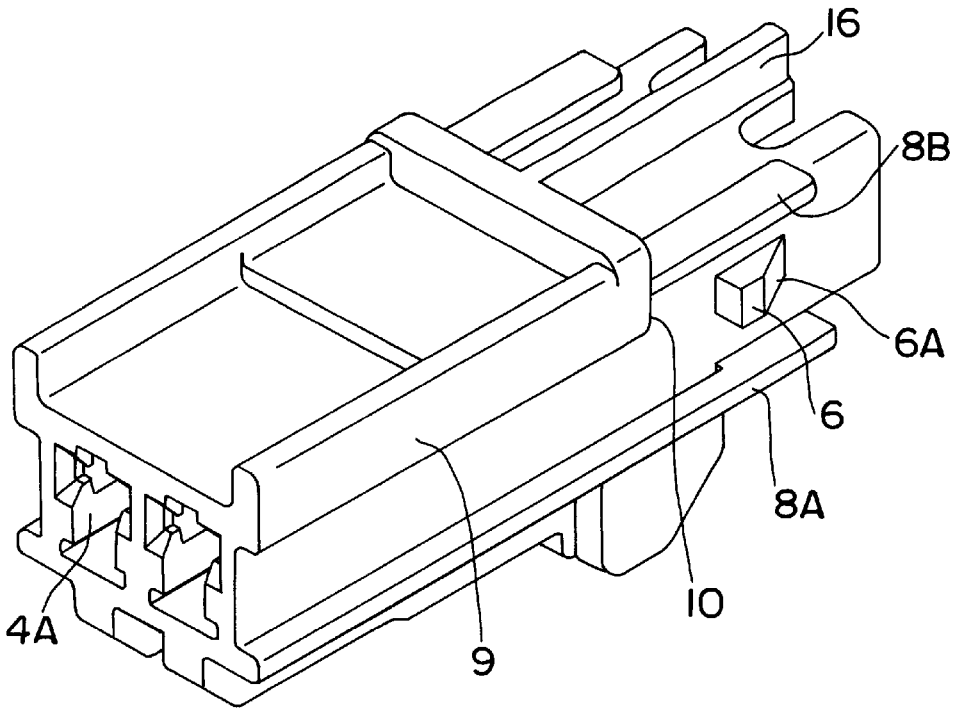
FIG. 2 is a perspective view showing the two-contact connector from bottom, showing a lower side thereof.
Figure 4:
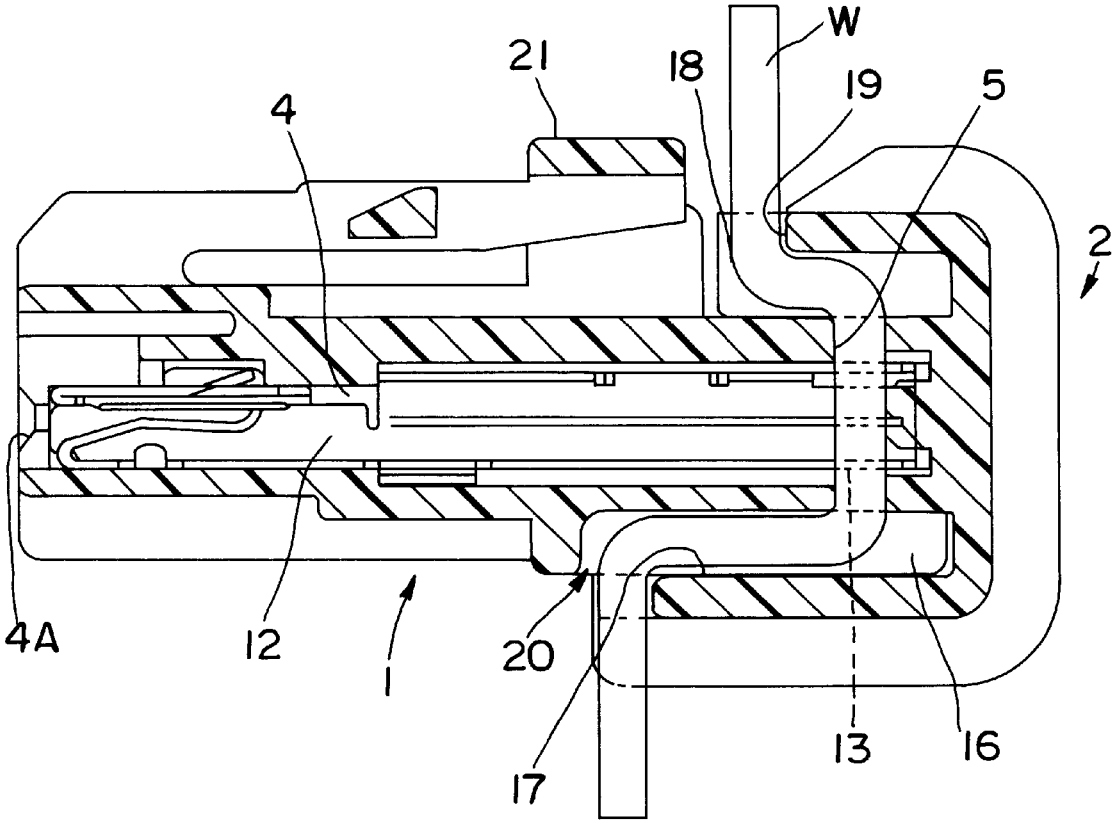
FIG. 4 is a side view in section of the two-contact cover-provided connector.

A housing-side projection 16 substantially extends along forward and backward directions in the middle of the lower surface of the connector housing 1. The projection 16 substantially extends from the step portions 10 to the rear end of the connector housing 1 (FIG. 2). Guiding spaces 20 are defined by the projection 16 and the bottom wall of the cover 2 when the cover 2 is assembled with the connector housing 1. The wires W connected with the female terminal fittings 12 are or can be guided by the guiding spaces 20 and can be drawn down below the lower surface of the connector housing 1, as shown in FIG. 4 while being individually partitioned.

The cover 2 is integrally or unitarily made e.g. of a synthetic resin, and is assembled to substantially cover the rear part of the connector housing 1 while bending the wires W. A mount opening 17 is formed in the front surface of the cover 2 and is slightly larger than the outer configuration of the connector housing 1. A pair of elastic engaging pieces 7 are formed on the opposite sides of the cover 2 and are sufficiently elastically deformable as to substantially widen a spacing therebetween. The elastic engaging pieces 7 are formed by a pair of upper and lower guide grooves 15 (corresponding to a receiving portion) formed in left and right walls 14 of the cover 2 and extend backward from the front ends of the walls 14. Thus, the elastic engaging pieces 7 are elastically deformable along a transverse direction with the rear ends thereof fixed as bases. The width of the guide grooves 15 are slightly larger than that of the locking portions 8 of the connector housing 1. An engaging groove 7A is formed in the middle of each elastic engaging piece 7 and extends forwardly from the rear end thereof. The locking projections 6 of the connector housing 1 are engageable with the engaging grooves 7A, and the connector housing 1 and the cover 2 are substantially locked into or with each other by this engagement.

At the upper wall of the cover 2, a cover-side projection 18 projects toward the inside of the mount opening 17. The projection 18 preferably extends vertically to a position substantially at the same height as the bottom edge (upper edges of the elastic engaging pieces 7) of the upper guide grooves 15, and preferably extends horizontally substantially from the opening edge of the mount opening 17 to the back surface of the cover 2. At the left and right sides of the projection 18 are formed a pair of wire grooves 19. When the connector housing 1 and the cover 2 are assembled, the wires W connected with the female terminal fittings 12 are drawn up above the upper surface of the connector housing 1 while being individually partitioned by this projection 18.

Figure 5:
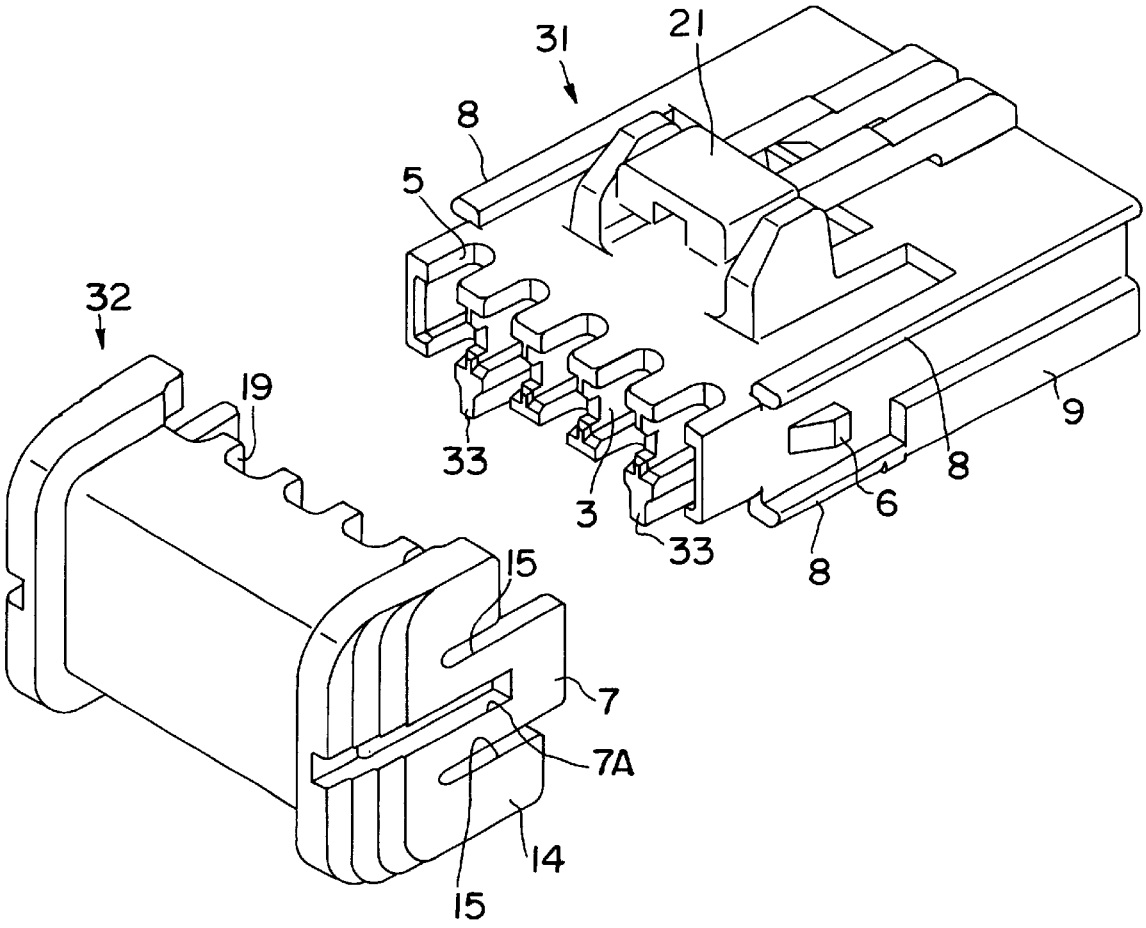
FIG. 5 is a perspective view showing a five-contact cover and a five-contact connector housing before they are assembled.
Figure 6:
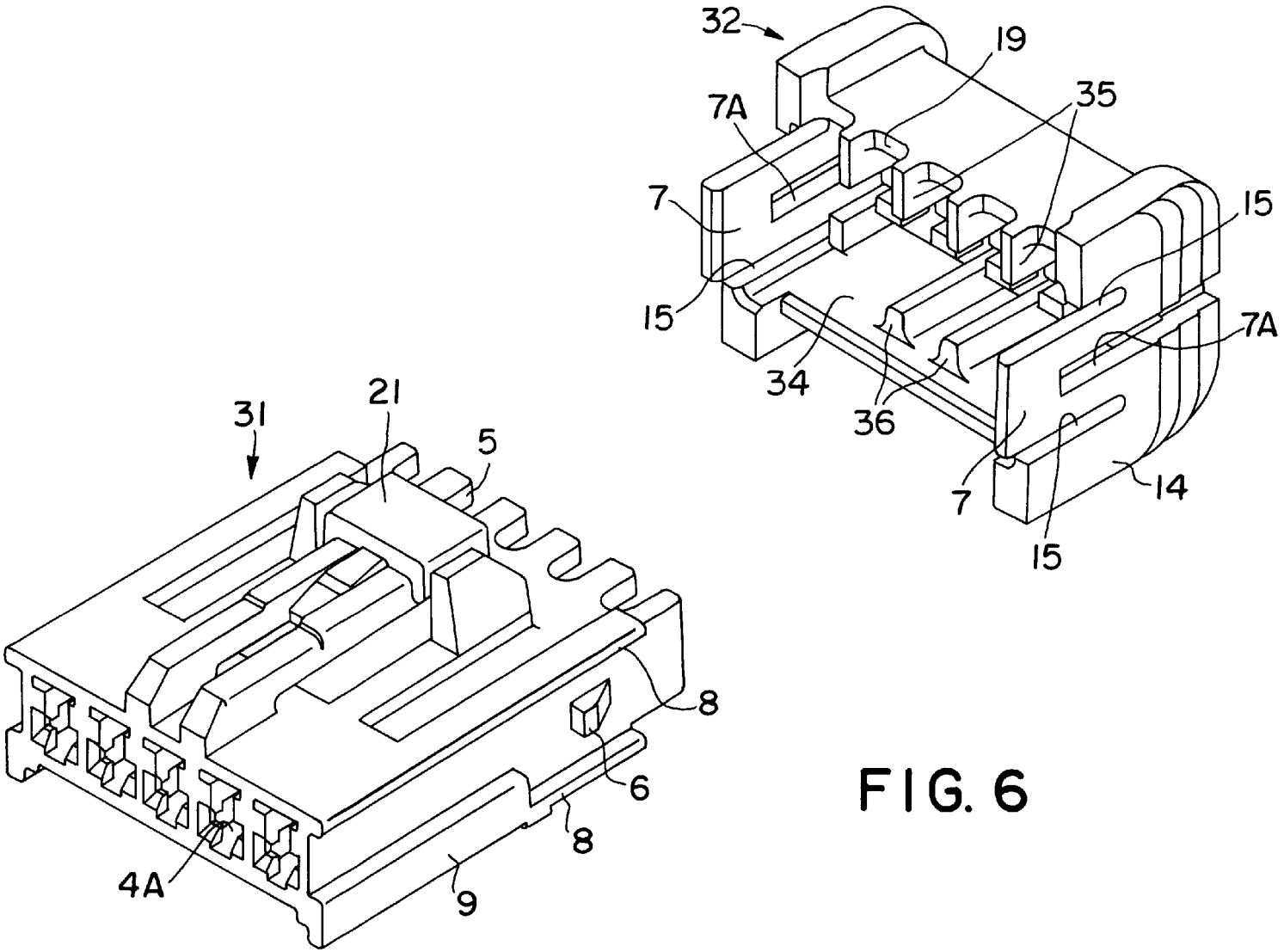
FIG. 6 is a perspective view showing the five-contact cover and the five-contact connector housing before they are assembled.

A five-contact cover-provided connector 30 is described with reference to FIGS. 5 and 6. It should be noted that elements on the connector 30 that are the same as or similar to the connector 11 are identified by the same reference numerals and description on the connector 30 is abbreviated accordingly.

In a five-contact connector housing 31, five cavities 4 are arranged substantially side by side. Two elongated housing-side projections 33 are provided preferably at the bottom side of the connector housing 31 and extend substantially from a position slightly behind a longitudinal center to the rear end of the connector housing 31. The projections 33 are located in positions of partition walls 3 provided between the cavities 4 at the opposite ends of the connector housing 31 and those located inside them.

A five-contact cover 32 has a mount opening 34 in the front surface of the cover 32 that is slightly larger than the outer configuration of the connector housing 31. Cover-side projections 35 project from the upper inner surface of the mount opening 34 substantially in alignment or flush with the four partition walls 3 of the connector housing 31. Two elongated cover-side projections 36 are provided on the lower inner surface of the mount opening 34 substantially in alignment with the two partition walls 3 in the middle of the connector housing 31. In other words, the cover-side projections 36 and the housing-side projections 33 are provided in positions where they do not interfere each other when the connector housing 31 and the cover 32 are assembled. The projections 33, 36 enable the wires W connected or connectable with the female terminal fittings 12 accommodated in the five cavities 4 to be guidably drawn.

The construction for holding the connector housing 31 and the cover 32 locked into or with each other, i.e. the locking projections 6 and the elastic engaging pieces 7, is the same or similar as those provided for the connector 11.

The two-contact connector 11 is assembled by first pushing the wires W into the crimping portions 13 of the female terminal fittings 12 that have been inserted into the cavities 4 of the connector housing 1 in advance. The crimping portions 13 substantially cut the insulation coatings of the wires W, thereby electrically connecting the cores of the wires W and the female terminal fittings 12.

In this state, the cover 2 is assembled preferably from behind the connector housing 1. The locking projections 6 come into contact with the leading ends of the elastic engaging pieces 7, when the connector housing 1 is pushed into the mount opening 17 of the cover 2, thereby elastically deforming the elastic engaging pieces 7 in such directions as to increase a spacing therebetween. At this time, since the cover 2 is provided with the guide grooves 15 in positions substantially corresponding to the locking (or guiding) portions 8 of the connector housing 1, the connector housing 1 can be smoothly pushed while being guided by the guide grooves 15.

Upon the completion of the assembling of the two-contact cover-provided connector 11, the guiding spaces 20 for drawing the wires W out of the connector 11 while partitioning them by the cover-side projection 18 are substantially defined between the opposing surfaces of the connector housing 1 and the cover 2 preferably at the top side of the connector housing 1. The guiding spaces 20 are defined by the housing-side projection 16 at the bottom side of the connector housing 1.

The five-contact cover-provided connector 30 is assembled by first, pushing the wires W into the crimping portions 13 of the female terminal fittings 12 that have been inserted into the cavities 4 of the connector housing 31 in advance to electrically connect the cores of the wires W and the female terminal fittings 12.

Subsequently, the cover 32 is assembled preferably from behind the connector housing 31. When the connector housing 31 is pushed into the mount opening 34 of the cover 32, the locking projections 6 come substantially into contact with the leading ends of the elastic engaging pieces 7, thereby elastically deforming the elastic engaging pieces 7 in such directions as to increase a spacing therebetween. At this time, since the cover 32 is provided with the guide grooves 15 in positions corresponding to the locking (or guiding) portions 8 of the connector housing 31, the connector housing 31 can be smoothly pushed while being guided by the guide grooves 15.

Upon the completion of the assembling of the five-contact cover-provided connector 31, the guiding spaces 20 are defined between the opposing surfaces of the connector housing 1 and the cover 2 at a top side of the connector housing 31. The guiding spaces enable a drawing of the wires W out of the connector 11 while partitioning them by the cover side projections 35. At the bottom side of the connector housing 31, five guiding spaces 20 are substantially defined by the cover-side projections 36 and the housing-side projections 33.

In this way, if the connector housings 1, 31 and the covers 2, 32 have the same number of positions of electric contacts, they can be assembled without the locking portions 8 and the cover-side projections 18, 35, 36 interfering with each other and also without the housing-side projections 16, 33 and the cover-side projections 18, 35, 36 interfering with each other.

The respective projections 16, 18, 33, 35, 36 also serve as wire guides for the wires W. Thus, it is not necessary to provide two separate members to prevent the error assembling and to partition the wires W.

Further, the guiding spaces 20 for drawing the wires W are defined by the housing-side projections 16, 33 and the cover-side projections 18, 35, 36. Therefore, two functions of preventing the error assembling of the connector housings 1, 31 and the covers 2, 32 and serving as the wire guide are performed by one member.

Figure 7:
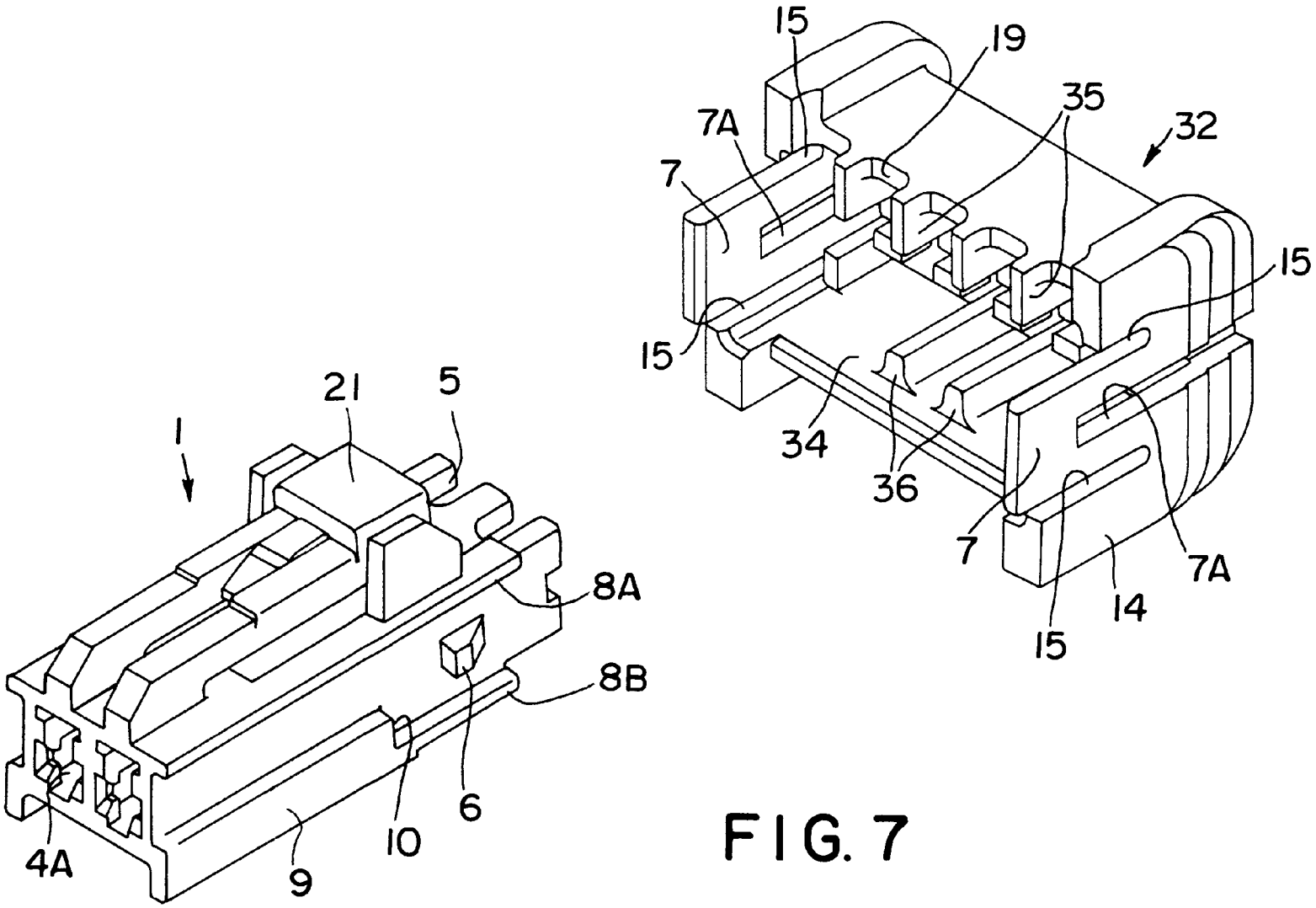
FIG. 7 is a perspective view showing the five-contact cover and the two-contact connector housing before they are assembled.

An attempt to erroneously assemble the five-contact cover 32 and the two-contact connector housing 1 is prevented as described with reference to FIGS. 7 and 8.

If the connector housing 1 is positioned in the middle of the cover 32, the locking projections 6 and the elastic engaging pieces 7 do not function to lock the connector housing 1 and the cover 32 into or with each other. Thus, a possible error assembling by an operator would be such that the left or right side surface of the connector housing 1 is aligned with the left or right elastic engaging piece 7 of the cover 32 (see FIG. 8).

Figure 8:
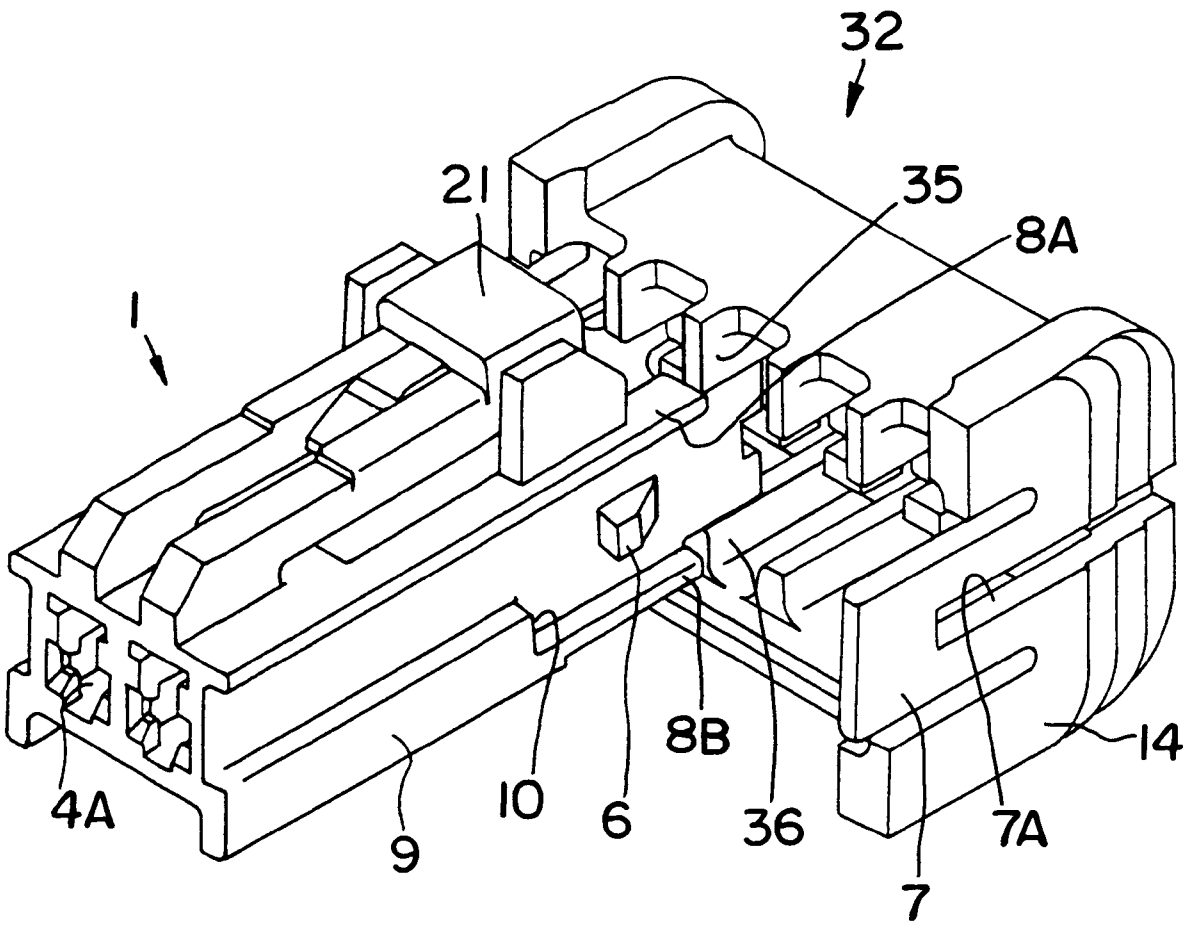
FIG. 8 is a perspective view when an attempt is made to assemble the five-contact cover and the two-contact connector housing.

In FIG. 8, an attempt is made to insert the connector housing 1 along the inner surface of the elastic engaging piece 7 (not shown in FIG. 8) at the left side of the cover 32. When the connector housing 1 is inserted into the mount opening 34 of the cover 32, the locking portions 8 shown on the right side of the connector housing 1 substantially come into contact with the cover-side projections 35, 36 of the cover 32. Thus, even if an attempt is made to forcibly insert the connector housing 1 into the cover 32, this cannot be done by the mutual interference of the locking portions 8 and the projections 35, 36. In this way, the error assembling of the connector housing 1 and the cover 32 can be prevented.

Figure 12A:
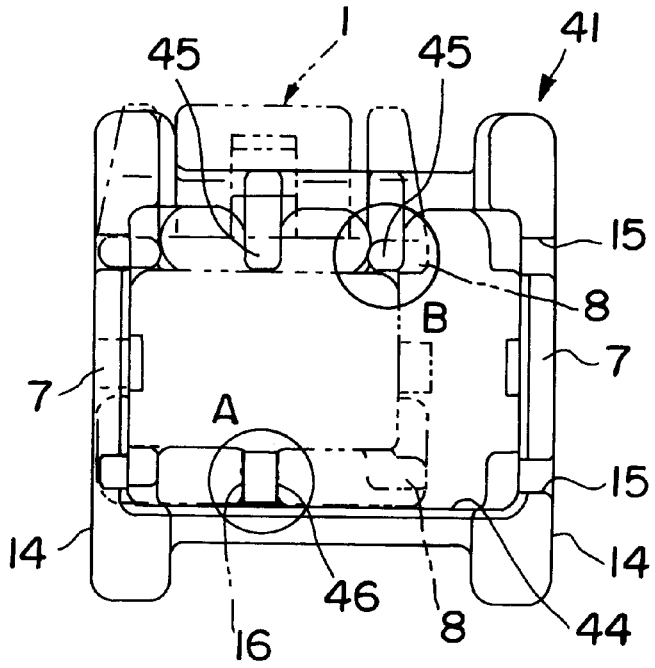
FIGS. 12(A) and 12(B) are front views showing an assembled state of a three-contact cover and the two-contact connector housing and an assembled state of the three-contact cover and a three-contact connector housing, respectively.
Figure 12B:
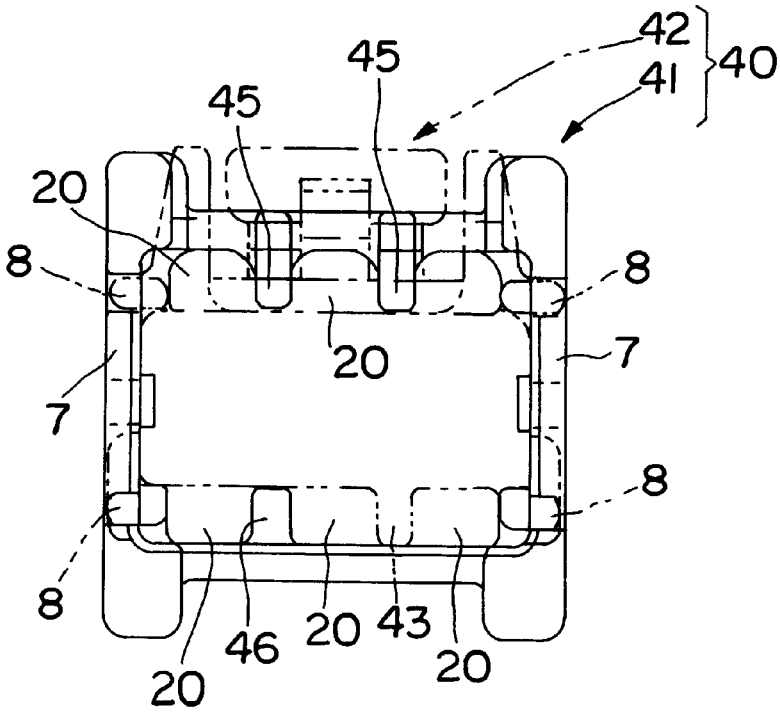
Figure 13A:
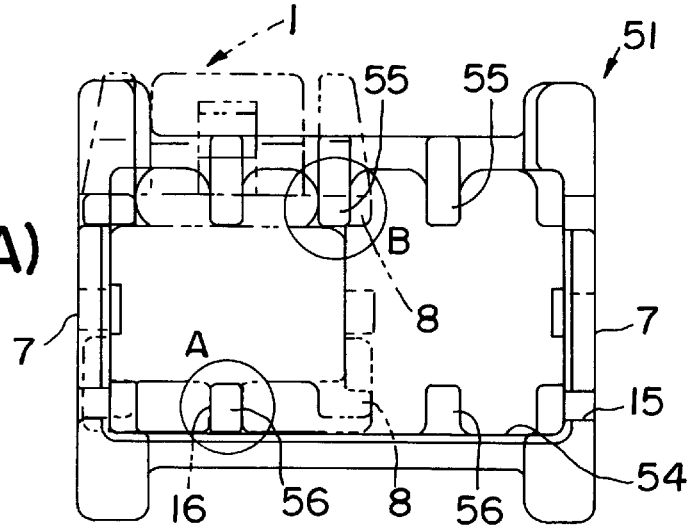
FIGS. 13(A), 13(B) and 13(C) are front views showing an assembled state of a four-contact cover and the two-contact connector housing, an assembled state of the four-contact cover and the three-contact connector housing, and an assembled state of the four-contact cover and the four-contact connector housing, respectively.
Figure 13B:
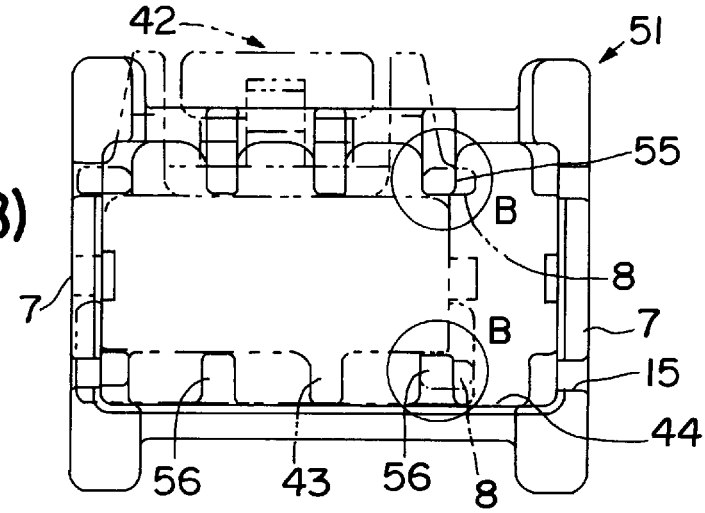

A three-contact cover-provided connector 40 is comprised of a three-contact cover 42 and a three-contact connector housing 41 and a four-contact cover-provided connector 50 is comprised of a four-contact cover 52 and a four-contact connector housing 51 as shown in FIGS. 12 and 13.

As shown in FIG. 12(B), three cavities 4 are provided in the connector housing 41 of the three-contact connector 40, and a housing-side projection 43 is provided on the preferably bottom surface of the connector housing 41 at the right side of FIG. 12(B). This projection 43 is provided substantially in alignment with a right one of two partition walls 3 partitioning the three-cavities 4.

A mount opening 44 of the cover 42 is slightly larger than the connector housing 41, and two cover-side projections 45 are provided substantially in parallel on the upper inner surface of the mount opening 44. Further, a cover-side projection 46 is provided on the lower inner surface of the cover 42 in a position substantially aligned with or symmetrical to the left cover-side projection 45.

When the connector housing 41 and the cover 42 thus constructed are assembled, guiding spaces 20 for guiding the wires W are substantially defined by the cover-side projections 45 at the top side of the connector housing 41. Further, at the bottom side of the connector housing 41, the housing-side projection 43 and the cover-side projection 45 are assembled without interfering each other. Guiding spaces 20 for guiding the wires W are defined by the connector housing 41 and the projections 43, 45 of the cover 42.

Figure 13C:
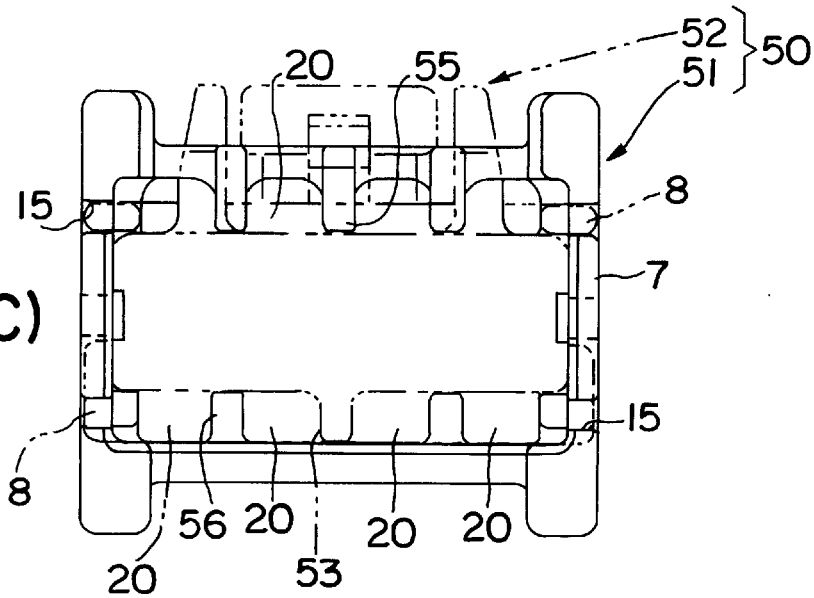
Figure 14A:
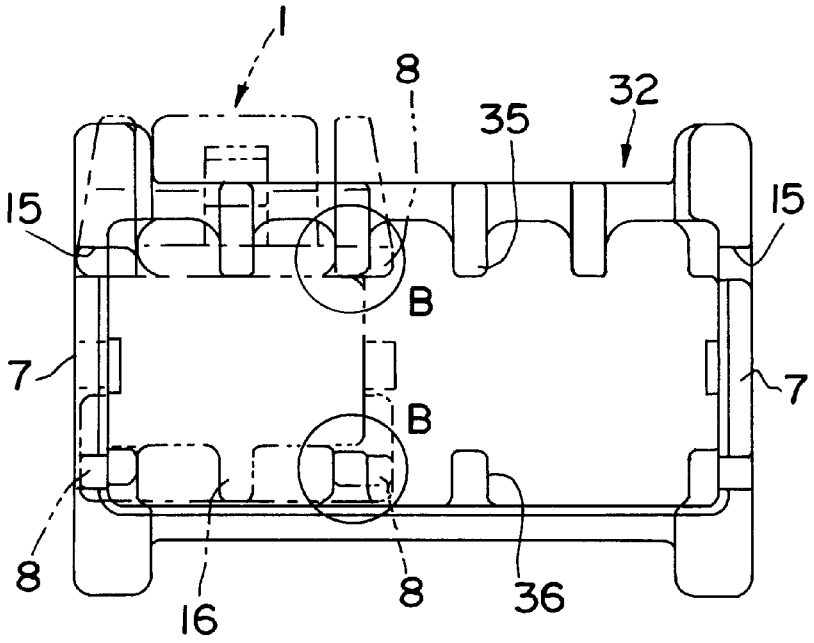
FIGS. 14(A) and 14(B) are front views showing an assembled state of the five-contact cover and the two-contact connector housing and an assembled state of the five-contact cover and the three-contact connector housing, respectively.
Figure 14B:
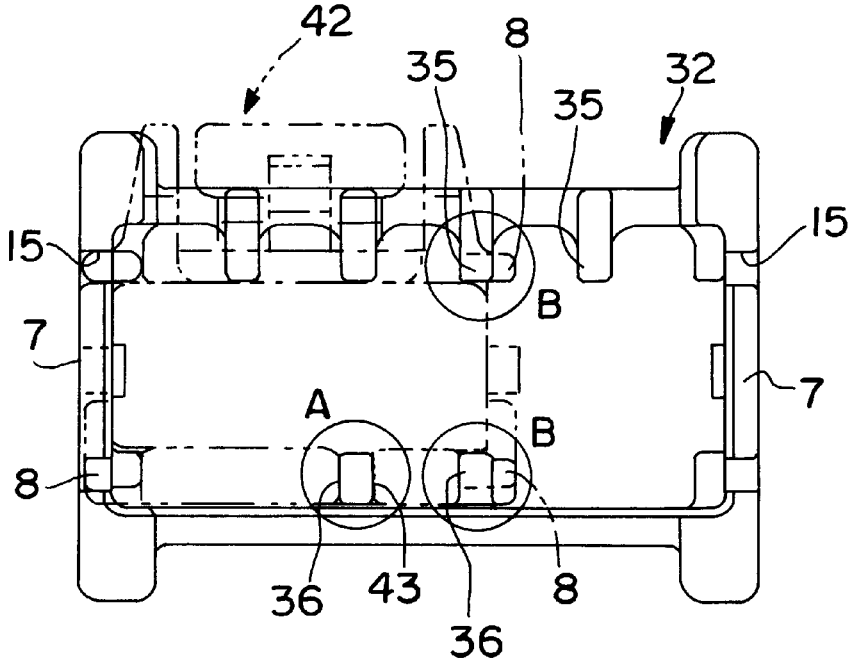
Figure 15A:
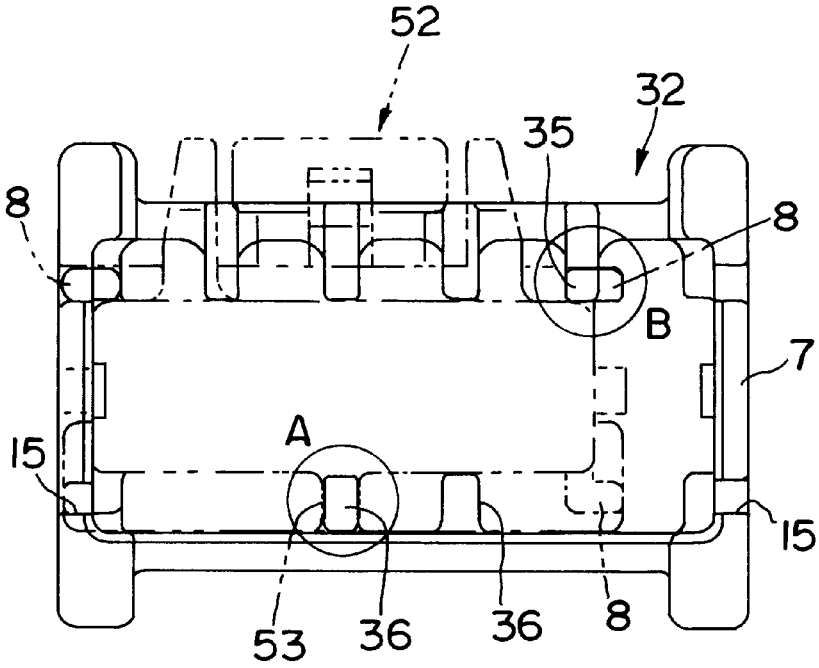
FIGS. 15(A) and 15(B) are front views showing an assembled state of an assembled state of the five-contact cover and the four-contact connector housing and an assembled state of the five-contact cover and the five-contact connector housing, respectively.
Figure 15B:
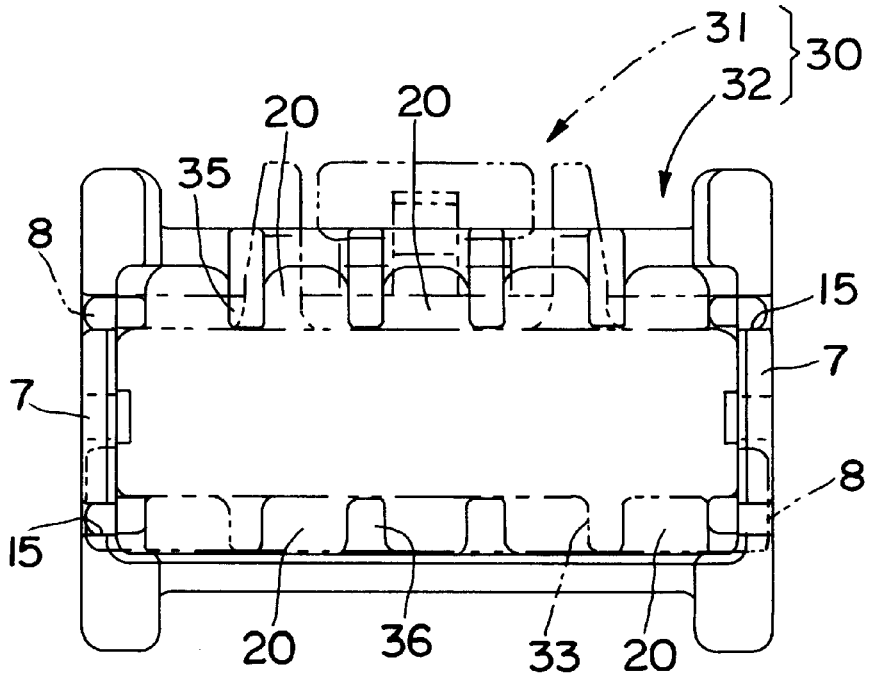

The four-contact cover-provided connector 50 is described with reference to FIG. 13(C). In particular, four cavities 4 are provided in the connector housing 51 of the connector 50. A housing-side projection 53 is provided preferably in the substantially middle of the lower surface of the connector housing, as shown.

A mount opening 54 of the cover 52 is slightly larger than the connector housing 51, and three cover-side projections 55 are provided at regular intervals or spacings or pitches on the upper inner surface of the mount opening 54. Further, two cover-side projections 56 are provided on the lower inner surface of the cover 52 substantially in alignment with or symmetrical to the left and right cover-side projections 55.

When the connector housing 51 and the cover 52 thus constructed are assembled, guiding spaces 20 for guiding the wires W are substantially defined by the cover-side projections 55 at the top side of the connector housing 51. The housing-side projection 53 and the cover-side projections 56 are assembled without interfering each other at the bottom side of the connector housing 51. Guiding spaces 20 for guiding the wires W are defined by the connector housing 51 and the projections 53, 56 of the cover 52.

Figure 9:
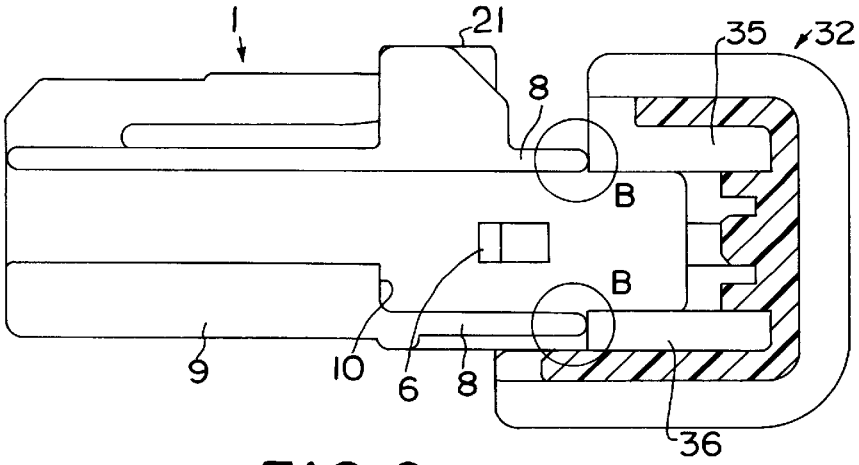
FIG. 9 is a side view in section showing a state where locking portions and cover-side projections interfere each other (interference B) upon an occurrence of an error assembling.
Figure 10:
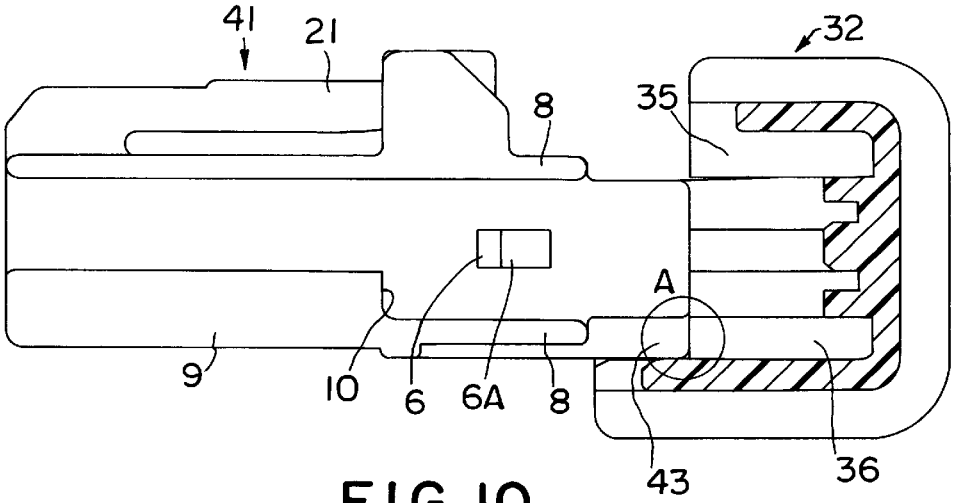
FIG. 10 is a side view in section showing a state where housing-side projections and cover-side projections interfere each other (interference A) upon an occurrence of an error assembling.
Figure 11:
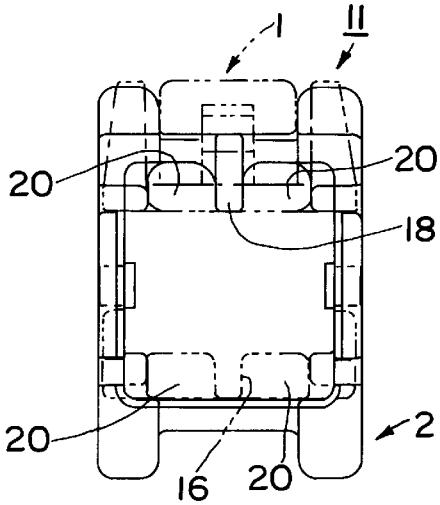
FIG. 11 is a front view showing the two-contact cover and the two-contact connector housing in their assembled state.

Two kinds of interferences, which might occur when the connector housings 1, 31, 41 and the covers 32, 42, 52 having a different number of positions of electric contacts than the corresponding connector housing are described with reference to FIGS. 9 and 10.

Interference of the locking portions 8 projecting from the upper and lower corners of the left and right sides of the connector housing 1 and the cover-side projections 35, 36 projecting at the upper and lower portions of the cover 32 as described in the prevention of the error assembling of the five-contact cover 32 and the two-contact connector housing 1 is referred to as "interference B". This interference B inevitably occurs at the top sides of the connector housings 1, 31, 41, 51 when they are assembled with the covers 32, 42, 52 having a different number of positions of electric contacts than the corresponding connector housing. The interference B might occur at the bottom sides of the connector housings 1, 31, 41, 51 depending on the combinations of the connector housings 1, 31, 41, 51 and the covers 32, 42, 52.

Depending on the combinations of the connector housings 1, 31, 41, 51 and the covers 32, 42, 52 having a different number of positions of electric contacts than the corresponding connector housing, the housing-side projections 16, 33, 43 may interfere with the cover-side projections 36, 46, 56 at the bottom sides of the covers 32, 42, 52. This interference is referred to as "interference A".

Next, the assembling of the connector housings 1, 31, 41, 51 and the covers 2, 32, 42, 52 are described with reference to FIGS. 11 to 15. In FIGS. 11 to 15, the covers 2, 32, 42, 52 are shown in solid line and the connector housings 1, 31, 41, 51 are shown in phantom line.

FIGS. 11, 12(B), 13(C) and 15(B) show the assembling of the connector housings 1, 31, 41, 51 and the covers 2, 32, 42, 52 having the same numbers of positions of electric contacts, respectively. In such cases, neither one of the interferences A, B occurs and the cover-provided connectors 11, 30, 40, 50 can be assembled.

During the assembling, the connector housings 1, 31, 41, 51 can be pushed smoothly and at least partially into the cover 2, 32, 42, 52 by the cooperation of the locking portions 8 and the guide grooves 15. Further, upon the completion of the assembling of the cover-provided connectors 11, 30, 40, 50, the guiding spaces 20 for guiding the wires W upwardly and downwardly are defined between the opposing surfaces of the connector housings 1, 31, 41, 51 and the covers 2, 32, 42, 52.

On the other hand, the remaining Figures show the assembling of the connector housings 1, 31, 41 and the covers 32, 42, 52 having different numbers of positions of electric contacts. In such cases, either the interference A or the interference B inevitably occurs to prevent the error assembling of the connector housings 1, 31, 41 and the covers 32, 42, 52.

The present invention is not limited to the foregoing embodiments. For example, the following embodiments are also embraced by the technical scope of the present invention as defined in the claims.

Although the housing-side projections are provided at the bottom side of the connector housing in the foregoing embodiments, they may be provided at the top side of the connector housing so as to serve also as the wire guides. In such a case, the cover-side projections at the upper side of the cover may be provided where there is no housing-side projection.

The housing-side projections at the bottom side of the connector housing may be omitted. Instead, cover-side projections may be provided at the bottom side of the cover in corresponding positions.

Although the connector housings have two to five positions of electric contacts in the foregoing embodiments, the number of positions sets or fittings of electric contacts may be not limited thereto, but may be six or more according to the invention.

Although only the female connectors are shown in the foregoing embodiments, the present invention may also be applicable to male connectors.

What is claimed is:

1. A connector having a construction for preventing an erroneous assembly of a connector housing and a cover having different numbers of positions of electric contacts, wherein the connector housing is provided internally with cavities disposed at an interval for accommodating terminal fittings, the cover being assembled with the connector housing depending on the number of positions of electric contacts of the connector housing, the cover guiding wires to be connected with the terminal fittings accommodated in the connector housing, the connector comprising:

locking portions provided on opposite side portions of the connector housing, receiving portions provided on opposite side surfaces of the cover for receiving the locking portions, and at least one projection on an inner surface of the cover in conformity with the interval of the cavities, wherein the connector housing and the cover are capable of being assembled without the locking portions and the projections interfering with each other if the connector housing and the cover have a same number of positions of electric contacts, whereas the locking portions and the projections interfere with each other to prevent an improper assembling of the connector housing and the cover if the connector housing has a smaller number of positions of electric contacts than the cover.

2. A connector according to claim 1, wherein the projections extend at least to a height of the receiving portions.

3. A connector according to claim 2, wherein the projections are wire guides for drawing wires connected with the terminal fittings out of the connector and partitioning the wires.

4. A connector according to claim 3, wherein the receiving portions comprise guide grooves which are open at a side of the cover to be connected with the connector housing and extend in a connection direction of the cover and the connector housing, the guide grooves guiding the cover in the connection direction by the engagement with the locking portions when the cover is assembled with the connector housing.

5. A connector having a construction for preventing an erroneous assembly of a connector housing and a cover having different numbers of positions of electric contacts, wherein the connector housing is provided internally with cavities disposed at an interval for accommodating terminal fittings, and the cover being assembled with the connector housing depending on the number of positions of electric contacts of the connector housing, the cover guiding wires so as to be connected with the terminal fittings accommodated in the connector housing, the connector comprising:

at least one housing-side projection and at least one cover-side projection provided on opposing surfaces of the connector housing and the cover and projecting toward the cover and the connector housing, respectively, wherein the connector housing and the cover can be assembled without the housing-side and cover-side projections interfering with each other if the connector housing and the cover have a same number of positions of electric contacts, whereas the housing-side and cover-side projections interfere with each other to prevent an improper assembling of the connector housing and the cover if the connector housing has a smaller number of positions of electric contacts than the cover.

6. A connector according to claim 5, wherein a space defined by the opposing surfaces of the connector housing and the cover are partitioned by the housing-side and cover-side projections into a number of partitioned spaces corresponding to the number of positions of electric contacts of the connector, and the respective partitioned spaces are guiding spaces for drawing the wires out of the connector.

7. A connector according to claim 6, wherein the cover holds wires connected with the terminal fittings accommodated in the connector housing in their bent state.

8. A connector comprising:

a connector housing being internally provided with a corresponding number of cavities for accommodating terminal fittings, covers having different numbers of positions of electric contacts, which can be assembled with the connector housing depending on the number of positions of electric contacts of the connector housing and guiding wires so as to be connected with terminal fittings accommodated in the connector housing, and a construction for preventing an erroneous assembling of the connector housing and the cover, the construction comprising:

locking portions provided on opposite side portions of the connector housing, receiving portions provided on opposite side surfaces of the cover for receiving the locking portions, and at least one projection on an inner surface of the cover in conformity with the interval of the cavities, wherein the connector housing and the cover are capable of being assembled without the locking portions and the projections interfering with each other if the connector housing and the cover have a same number of positions of electric contacts, whereas the locking portions and the projections interfere with each other to prevent an improper assembling of the connector housing and the cover if the connector housing has a smaller number of positions of electric contacts than the cover.

9. A connector according to claim 8, wherein a mating connector can be connected to the connector housing at an end thereof substantially opposite from the end where the cover is to be connected.

* * * * *